United States Patent [19]

Alter et al.

[11] 4,008,650

[45] Feb. 22, 1977

[54] METHOD AND APPARATUS FOR FORMING EXPANSIBLE ENVELOPE

[76] Inventors: Seymour B. Alter, 31 Brionfield Drive, Great Neck, N.Y. 11020; Eugene Turkenkopf, 1323 Taft Road, Teaneck, N.J. 07666

[22] Filed: June 11, 1975

[21] Appl. No.: 586,099

[52] U.S. Cl. ..... 93/62; 93/13; 93/35 SB

[51] Int. Cl.[2] ..... B31B 29/26

[58] Field of Search ..... 93/61 R, 62, 63 R, 63 M, 93/13, 8 R, 35 SB, 35 R; 229/68 R

[56] References Cited

UNITED STATES PATENTS

| | | | |
|---|---|---|---|
| 2,903,947 | 9/1959 | Weisshuhn | 93/13 X |
| 3,198,420 | 8/1965 | Hiersteiner | 229/68 |
| 3,552,640 | 1/1971 | Young | 229/68 R |
| 3,808,768 | 5/1974 | Dobbs | 93/63 R X |
| 3,860,164 | 1/1975 | Dworkin | 229/68 R X |

*Primary Examiner*—James F. Coan
*Attorney, Agent, or Firm*—Kane, Dalsimer, Kane, Sullivan and Kurucz

[57] ABSTRACT

An improved method and apparatus for taking a precut one-piece unitary blank and forming it into an expansible container and the like.

4 Claims, 13 Drawing Figures

METHOD AND APPARATUS FOR FORMING EXPANSIBLE ENVELOPE

BACKGROUND OF THE INVENTION

In copending application Ser. No. 484,141, filed June 28, 1974, there is disclosed an improved envelope container and the like (hereinafter simply referred to as an envelope).

Expansion envelopes are extensively used in many fields. One of many common applications of such envelopes is as a prepaid mailer for film processing or the like. The envelope can be stored and sent flat prior to use and then expanded during use sufficiently to receive and securely contain the contents therein.

Heretofore, several forms of expansible envelopes have been proposed as exemplified by U.S. Pat. Nos. 67,111; 442,842; 681,472; 2,188,730; 2,281,452; 2,460,909; 3,414,185; and 3,552,640. In the main, in each case, the prior art envelope had a single glued seam extending down the middle of the front or rear panel.

The present invention provides apparatus with improved elements and steps for scoring, applying adhesive and folding a precut one-piece unitary blank into the expansible envelope described and claimed in the aforesaid pending application.

SUMMARY OF THE INVENTION

It is an object of the present invention to provide an improved method and apparatus for forming a precut one-piece unitary blank into an improved expansible envelope.

It is a further object to provide improved apparatus for forming such improved expansible envelope which is simple and economical to manufacture and operate and performs the improved method of the present invention, which apparatus and method are efficient and well suited for their intended purpose.

BRIEF DESCRIPTION OF THE DRAWINGS

Other objects and advantages will become apparent from the following description which is to be taken in conjunction with the accompanying drawings, in which.

DESCRIPTION OF THE PREFERRED EMBODIMENT

Figure 1:
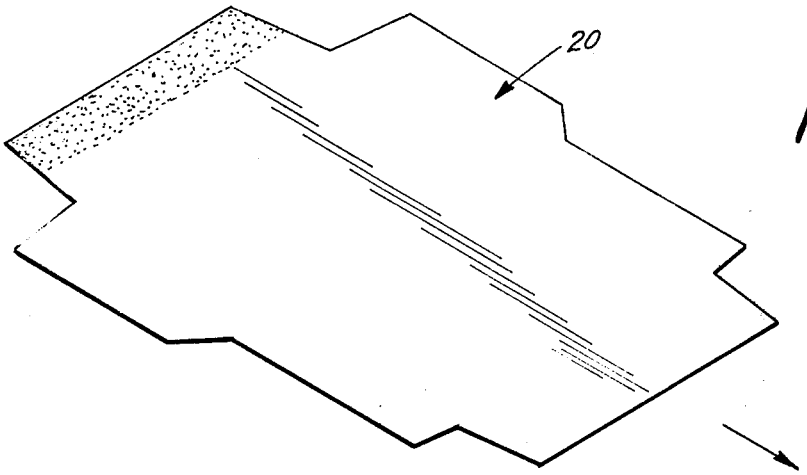
FIG. 1 is a perspective view of a blank for forming an expansible envelope without any score lines, fold lines or perforations.

In the drawings, we have shown one preferred form of envelope made by our method; but as will be seen other modified forms may also be made.

Figure 8:
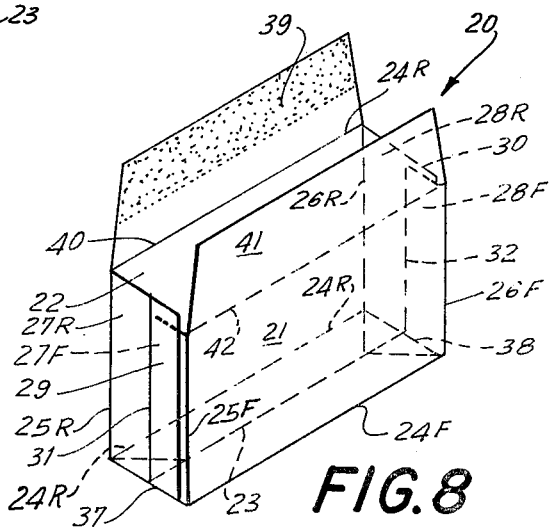
FIG. 8 is a view of the envelope of FIG. 7 in expanded open position with the label and cover flaps in erect unfolded position.
Figure 9:
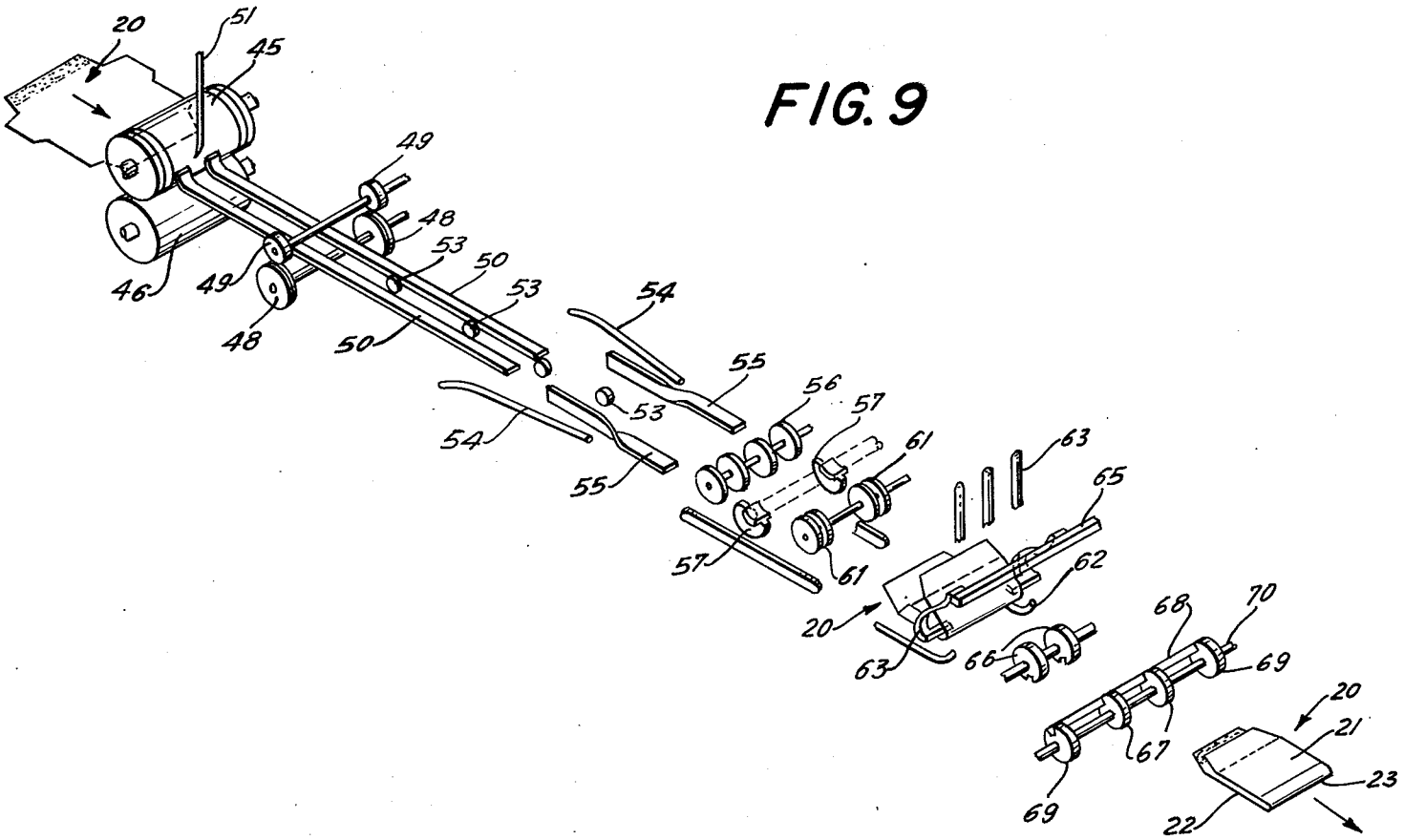
FIG. 9 is an exploded view of the various elements of the apparatus of the present invention.
Figure 10A:
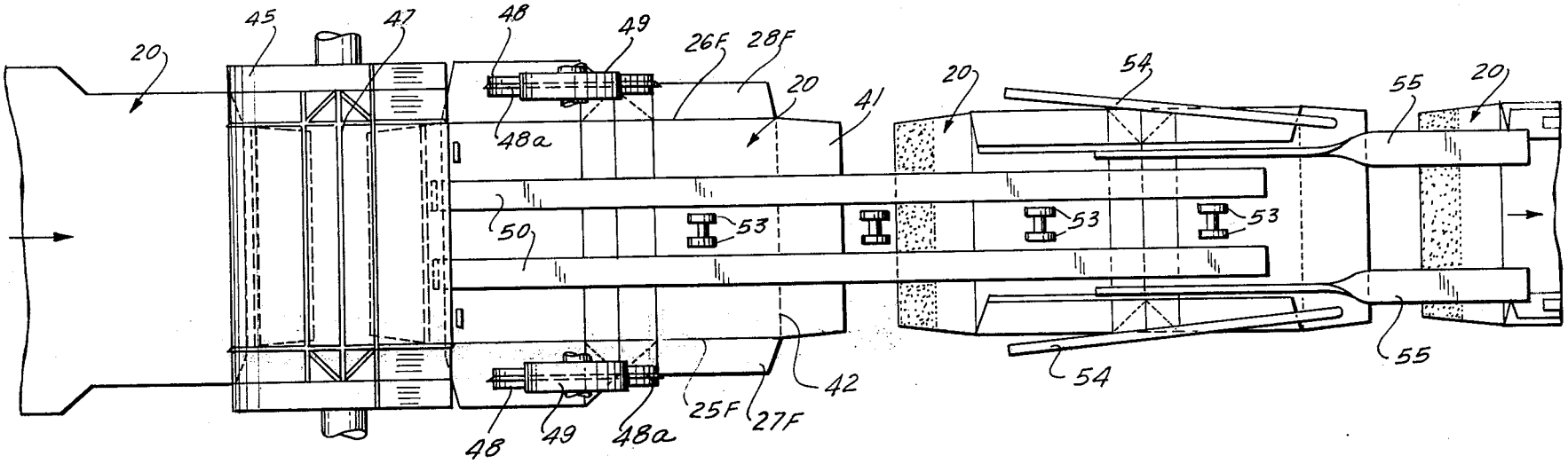
FIGS. 10A and 10B together form a top plan view of the apparatus of the present invention.
Figure 10B:
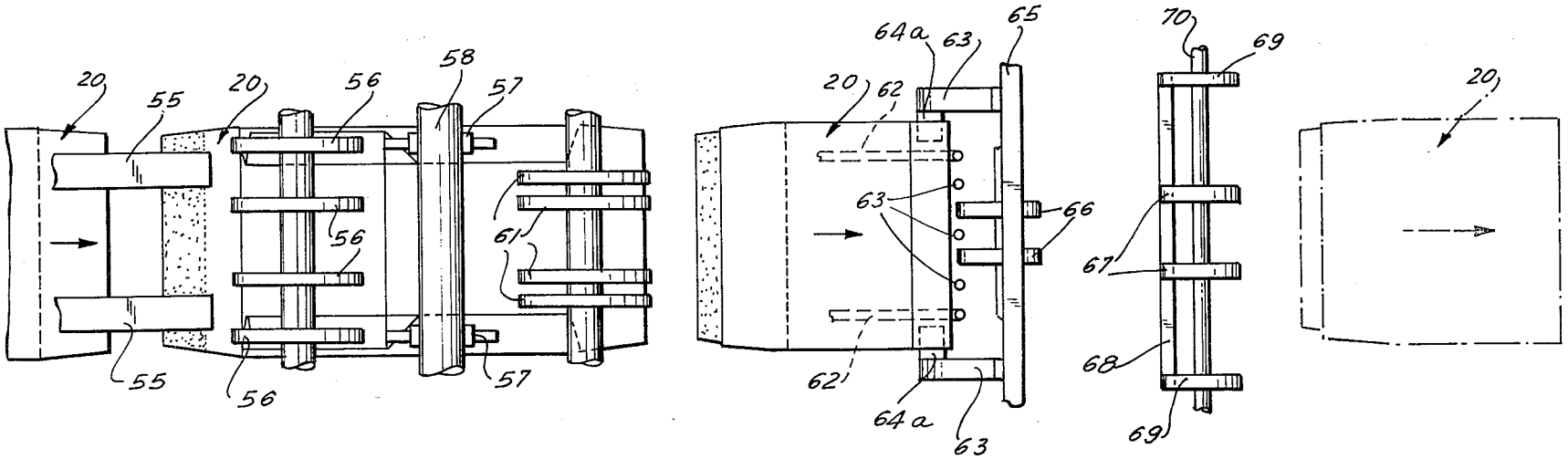
Figure 11A:
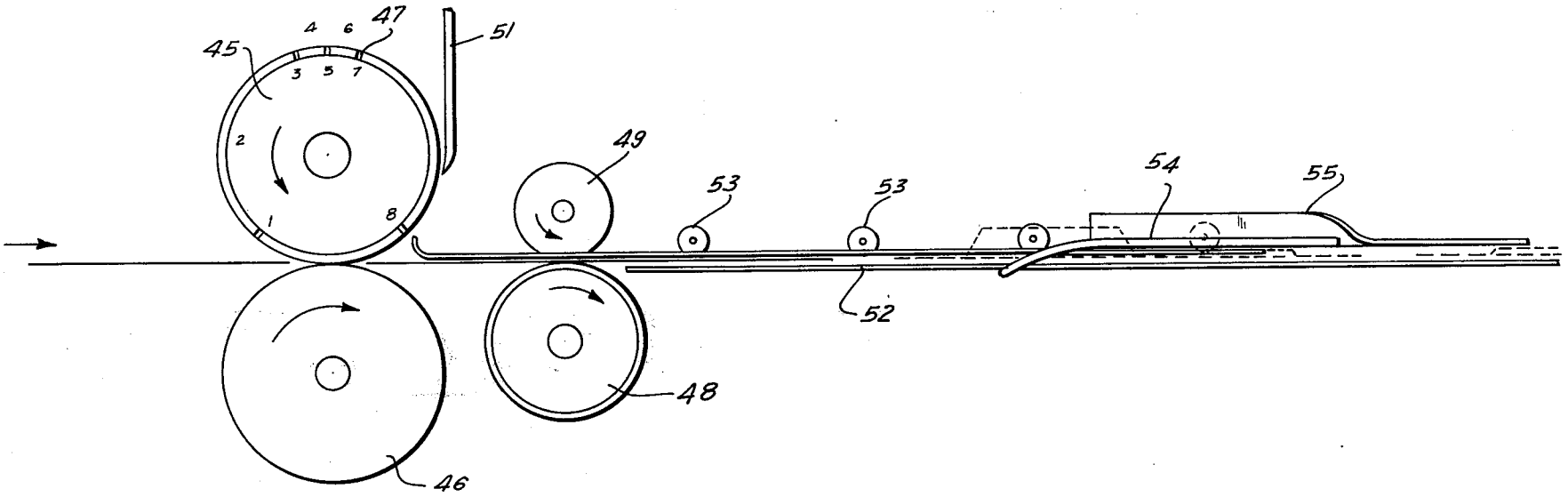
FIGS. 11A and 11B together form a side elevation view of the apparatus of the present invention.
Figure 11B:
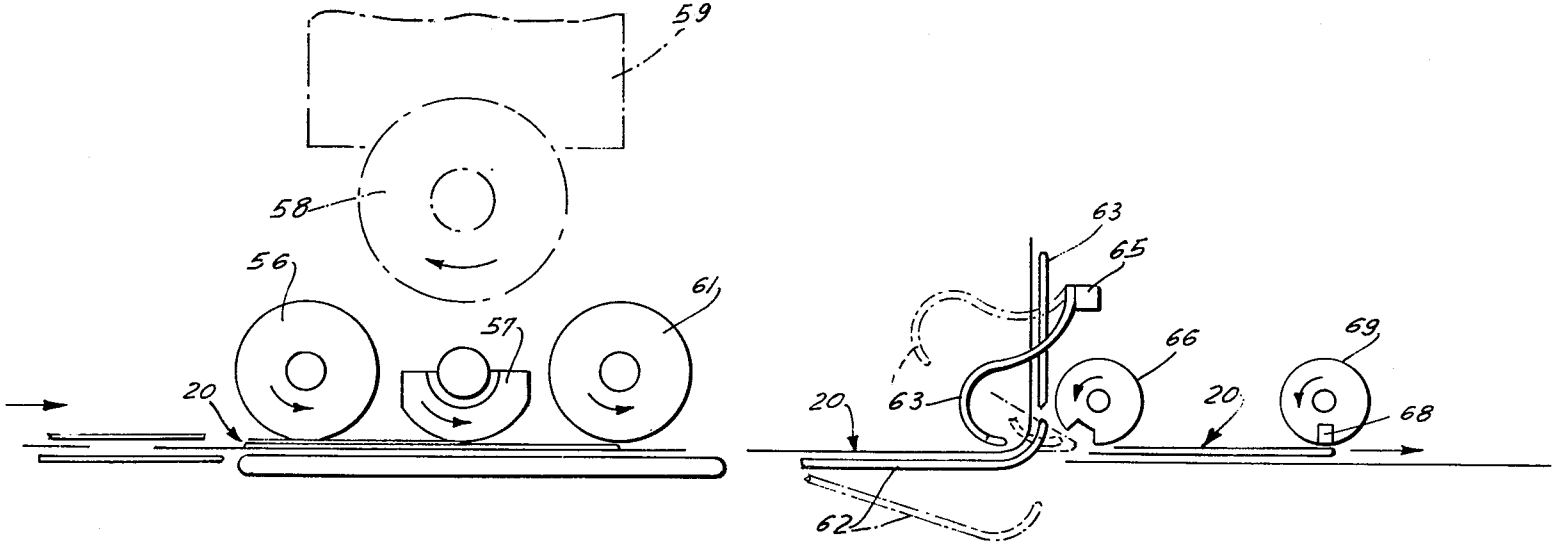

Referring to the drawings, there is shown in FIG. 8 the completed and erected expansible envelope to be formed by the method and apparatus of the present invention. Such envelope formed from a blank 20 comprises a generally rectangular back panel 21, a front panel 22, and a bottom panel 23 extending between the front and rear panels. The bottom panel is connected to the front panel along a bottom hinge score line 24F and to the rear panel along a bottom hinge score line 24R. Connected to the sides of the front panel along hinge score lines 25F and 26F are front gusset flaps 27F and 28F. Similarly, rear gusset flaps 27R and 28R are connected to the rear panel along hinge score lines, respectively, 25R and 26R. The gusset flaps 27F and 27R and 28F and R are interconnected by adhesive flaps 29 and 30 which are connected, respectively, to the rear gusset flaps 27R and 28R along gusset hinge score lines 31 and 32. Such adhesive flaps 29 and 30 overlap and are adhesively secured to the front gusset flaps 27F and 28F.

The bottom panel 23 is generally rectangular in shape the coextensive in length with the front and rear panels to which it is connected. A center bottom hinge score line 33 extends longitudinally across the bottom panel. Connected to each end of the bottom panel 23 and the gusset flaps are front and rear bottom gusset panels 34 and 35, each of which is divided by a diagonal fold line 36 extending from (a) the intersections of the side hinge score lines (25F, 26F, 25R and 26R) and the bottom hinge score lines (24F and 24R) to (b) the outer ends of the center bottom hinge score line 33. Such bottom gusset panels 34 and 35 are connected to the bottom panel along hinge score lines 37 and 38 and to the gusset flaps by continuations of the hinge score lines 24F and 24R.

The expansible envelope includes a top panel 39 connected to the rear panel 22 along a hinge score line 40. Also optionally it may include a label panel 41 which is connected to the front panel 21 along a perforated score line 42.

There are also triangular extensions **29*a* and 30*a* of the adhesive flaps 29 and 30 which are connected to such adhesive flaps and rear bottom gusset panels 35R by extensions of the hinge score lines 24R and 31 and 32.**

Referring to FIGS. 9–11B, inclusive, and FIGS. 1–8, inclusive, the method and apparatus of the present invention for forming such expansible envelope will be described. The starting blank 20 is shown in FIG. 1 with adhesive already applied and dried on the area which will form the top closure panel 39. This blank with the front panel leading is fed by aligner pins into a pair of driven top scoring rolls 45 and 46. The upper scoring roll 45 is a hard roll with a series of blades formed into a pattern 47 on its surface to impress on the top of the blank all of the hinge and perforated score lines shown in FIG. 2. The lower scoring roll 46 is preferably made of rubber to insure the top scoring and perforating when the blank is fed between the rolls.

Figure 2:
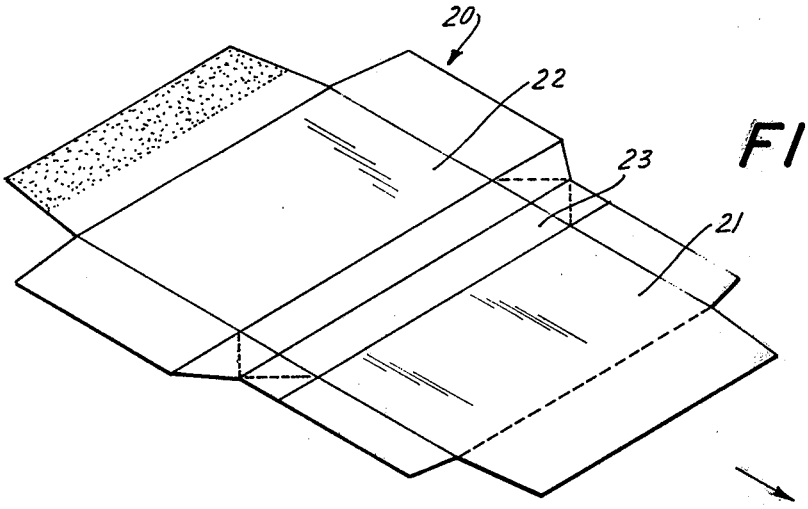
FIG. 2 is a view similar to that of FIG. 1 showing the various top fold lines and perforations made by the scoring drum.
Figure 3:
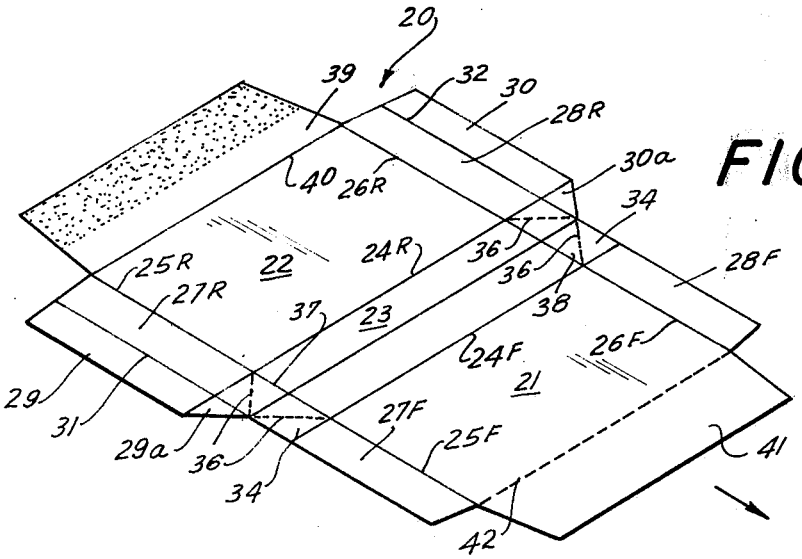
FIG. 3 is a view similar to that of FIG. 2 showing the remainder of the fold lines preferably made by scoring wheels.

The top scored and perforated blank, shown in FIG. 2, passes from the top scoring rolls 45 and 46 into reverse scoring rolls 48 and 49 on each side of the machine. Each lower reverse scoring roll 48 has a hard scoring edge 48*a* running around its circumference and is positioned to impress the hinge score lines 31 and 32 and their extensions into the blank (FIG. 3). Each upper scoring roll 49 is preferably made of rubber to insure the reverse scoring when the blank is fed between the rolls. In traveling from the top scoring rolls 45 and 46 to the reverse scoring rolls 48 and 49 the blank passes beneath a pair of forming blades 50 which run from the top scoring rolls to the folding means. The ends of such blades adjacent the top scoring rolls are curved to direct the blank beneath such strips. In addition there is a pickoff strip 51 directed downward to the top scoring roll 45 to pick off any blank which may pass the ends of the forming blades and move upwardly against such top score roll.

When the blank moves out of the reverse scoring rolls 48 and 49 it goes under the forming blades 50. It then moves onto a table 52 running from such scoring rolls for virtually the full length of the machine. The blank is moved forward by spaced drive wheels 53 positioned at intervals to make contact with the top of the blank.

Figure 4:
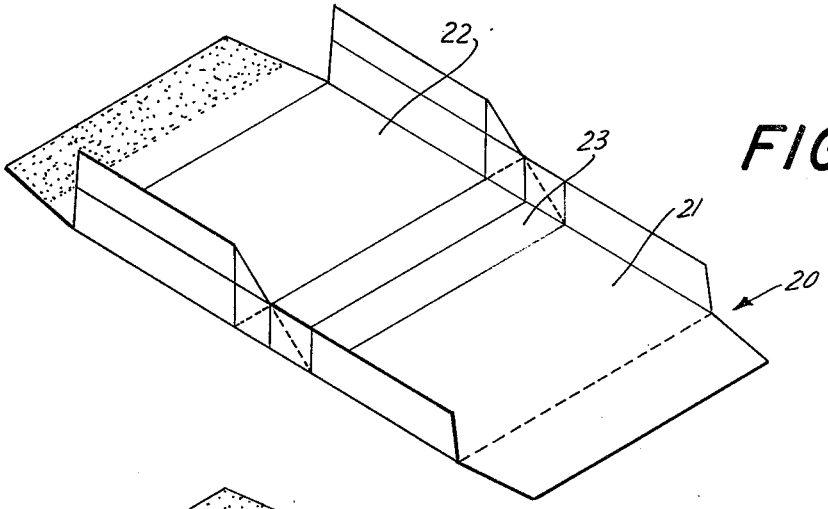
FIG. 4 is a view of the blank of FIG. 3 with the gusset panels folded into an upright position.
Figure 5:
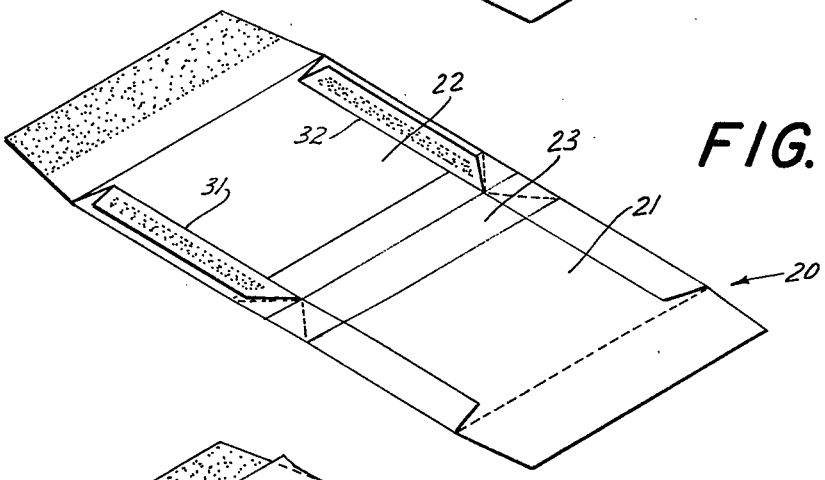
FIG. 5 is a view of the blank of FIG. 4 with the gusset panels reverse folded against their adjacent panels, the adhesive gusset panels reverse folded against the gusset panels and adhesive applied to the adhesive gusset panels.

The next step in the operation is the folding inwardly 180°, along the hinge score lines 25 (F and R), 26(F and R), 37 and 38, of the adhesive flaps 29 and 30, gusset flaps 28 (F and R) and 27 (F and R) and bottom gusset panels 34 and 35 (FIGS. 4 and 5). Such flaps and panels are first turned upwardly into the position shown in FIG. 4 by the folding rods 54 on each side of the machine adapted to contact the outer edges of the blank and turn such flaps and panels until they are in the upright position shown. The moving blank then comes into contact with reverse folding rods 55 on each side of the machine adapted to move beneath the adhesive flaps 29 and 30 and fold such flaps outwardly 180° along the hinge score lines 31 and 32 and their extensions (FIG. 5).

The blank now passes beneath a plurality of pressing drive wheels 56 which press down the adhesive flaps and move the blank into the adhesive rolls 57. Such adhesive rolls 57 pick up adhesive from an upper adhesive roll 58 which in turn picks up adhesive from an adhesive receptacle 59. The adhesive rolls 57 cooperate with a pair of back up rolls 60 when applying adhesive to the adhesive flaps 29 and 30 (FIG. 5).

Figure 6:
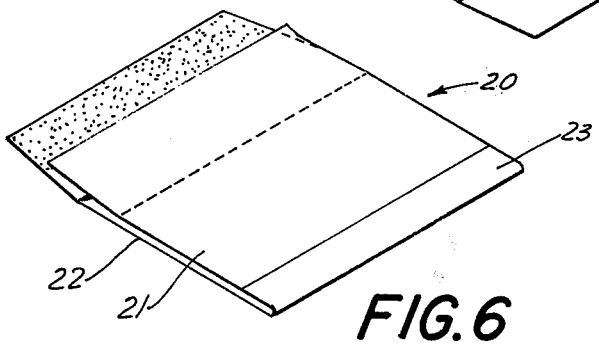
FIG. 6 is a view of the blank of FIG. 5 with the front and rear panels folded into superimposed position and the gusset panels of the front panel applied to the adhesive gusset panels of the rear panel.
Figure 7:
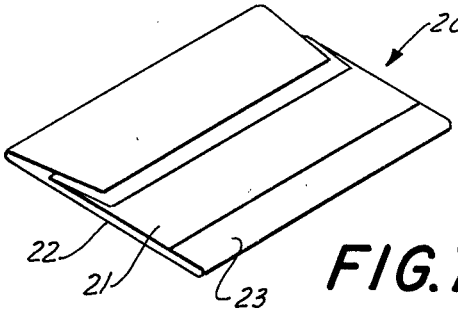
FIG. 7 is a view of the envelope of FIG. 6 with the label flap and cover flap folded over the body of the envelope.

The blank is directed from between the adhesive rolls 57 and back up rolls 60 into another plurality of drive wheels 61 which move the blank to the final folding and tucking means. Such final folding means (FIGS. 9, 10B and 11B) folds the blank along the hinge score line 33 and superimposes the front panel 21 over the top of the rear panel 22 and the front gusset flaps 27F and 28F over the rear gusset flaps 27R and 28R. The adhesive flaps 29 and 30 are in the same operation secured to the front gusset flaps 27F and 28F (FIG. 6). Such final folding is accomplished by the cooperation and interengagement of lifters 62, the vertical guides 63 and the tuckers 64. In the first step the leading edge of the forward moving blank comes into contact with the lifters 62 which are adapted to turn the forward portion of the blank upward into the vertical guides 63. At the same time the hook shaped tuckers 64 which are mounted on a rotatable beam 65 move downwardly toward the blank and the inward projections 64*a* of the tuckers 64 press against the bottom gusset panels 35 to insure that the forward portion of the blank will fold along the hinge score line 33. As such tuckers move into position the lifters then retract downwardly to get out of the way of the forward moving blank. Further rotation of the tuckers moves the folded bottom into the cutouts 66*a* of feed rolls 66 where the front panel 21 is superimposed against the rear panel 22. The feed rolls 66 deliver the folded blank into the next set of feed rolls 67, which contain a pressure bar 68 mounted on two support rolls 69 and across the feed rolls 67. The support rolls 69 and the feed rolls 67 are rotated on a shaft 70. The pressure bar 68 flattens the folded bottom and the feed rolls 67 deliver the folded blank to a delivery section where the top closure panel and the label panel (if present) may be folded or left extended. When the blank moves away from the lifters and tuckers, such lifters and tuckers go back to their initial position ready for the next blank.

Thus among others, the several aforenoted objects and advantages are most effectively attained. Although a somewhat preferred embodiment of the invention has been disclosed and described in detail herein, it should be understood that this invention is in no sense limited thereby and its scope is to be determined by that of the appended claims.

Having thus described the invention, what is claimed is:

1. The method of forming an expansible envelope into a substantially flat condition from a precut one-piece blank of sheet material having adhesive applied to the top edge of the blank comprising:

a. scoring the blank to define
   i. rear, bottom and front panels interconnected along generally parallel longitudinal hinge score lines;
   ii. gusset flaps connected to the sides of the front and rear panels along transverse hinge score lines;
   iii. bottom gusset panels connected to the ends of the bottom panel along transverse hinge score lines and the ends of the gusset flaps adjacent the bottom panel along longitudinal hinge score lines;
   iv. a median longitudinal hinge score line running through the bottom panel and the bottom gusset panels;
   v. adhesive flaps connected to a gusset flap on each side of the blank along transverse hinge score lines, said adhesive flaps each having an extension at one end running to the said median longitudinal hinge line and being connected along a hinge score line to its adjacent bottom gusset panel; and
   vi. a closure panel connected to the top of the rear panel along a longitudinal hinge score line;
b. folding inwardly the gusset flaps, the adhesive flaps and their extensions, and the bottom gusset panels;
c. reverse folding outwardly the adhesive flaps and their extensions over the adjacent gusset flaps;

d. applying adhesive along the top surfaces of only the adhesive flaps with the bottom panels being free of adhesive;

e. folding the blank along the median longitudinal hinge score line to superimpose the front and rear panels, the adhesive flaps and the gusset flaps, and the adjacent portions of bottom gusset panels, the folding of the blank along the median longitudinal hinge score line comprising turning the leading edge of the blank upward, holding the blank in the gusset area adjacent the said median score line, and moving the blank under pressing means to direct the front panel backward to superimpose the front panel over the rear panel; and reverse folding the closure panel over the front panel.

2. The method of forming an expansible envelope from a precut one-piece blank of sheet material having adhesive applied to the top edge of the blank comprising:

a. scoring the blank to define i. rear, bottom and front panels interconnected along generally parallel longitudinal hinge score lines;

ii. gusset flaps connected to the sides of the front and rear panels along transverse hinge score lines;

iii. bottom gusset panels connected to the ends of the bottom panel along transverse hinge score lines and the ends of the gusset flaps adjacent the bottom panel along longitudinal hinge score lines;

iv. a median longitudinal hinge score line running through the bottom panel and the bottom gusset panels;

v. adhesive flaps connected to a gusset flap on each side of the blank along transverse hinge score lines, said adhesive flaps each having an extension at one end running to the said median longitudinal hinge line and being connected along a hinge score line to its adjacent bottom gusset panel; and vi. a closure panel connected to the top of the rear panel along a longitudinal hinge score line;

b. folding inwardly the gusset flaps, the adhesive flaps and their extensions, and the bottom gusset panels, c. reverse folding outwardly the adhesive flaps and their extensions over the adjacent gusset flaps;

d. applying adhesive along the top surfaces of the adhesive flaps;

e. folding the blank along the median longitudinal hinge score line to superimpose the front and rear panels, the adhesive flaps and the gusset flaps, and the adjacent portions of bottom gusset panels;

f. the blank including an extension to provide a label panel over the front panel, perforating the blank to define a label panel connected to the front panel along a longitudinal perforated line; and g. reverse folding of the closure panel and the label panel over the front panel to position the label panel between the closure panel and the front panel.

3. Apparatus for forming an expansible envelope into a substantially flat condition from a precut one-piece blank of sheet material comprising:

a. means to score the blank to define i. rear, bottom and front panels interconnected along generally parallel longitudinal hinge score lines;

ii. gusset flaps connected to the sides of the front and rear panels along transverse hinge score lines;

iii. bottom gusset panels connected to the ends of the bottom panel along transverse hinge score lines and the ends of the gusset flaps adjacent the bottom panel along longitudinal hinge score lines;

iv. a median longitudinal hinge score line running through the bottom panel and the bottom gusset panels;

v. adhesive flaps connected to a gusset flap on each side of the blank along transverse hinge score lines, said adhesive flaps each having an extension at one end running to the said median longitudinal hinge line and being connected along a hinge score line to its adjacent bottom gusset panel;

vi. a closure panel connected to the top of the rear panel along a longitudinal hinge score line; and vii. an extension to provide a label panel;

b. means to fold inwardly the gusset flaps, the adhesive flaps and their extensions and the bottom gusset panels;

c. means to fold outwardly the adhesive flaps and their extensions over the adjacent gusset flaps;

d. means for applying adhesive along the top surfaces of only the adhesive flaps with the bottom panels being free of adhesive;

e. means to fold the blank along the median longitudinal hinge score line to superimpose the front and rear panels, the adhesive flaps and the gusset flaps, and the adjacent portions of the bottom gusset panels;

f. means to perforate the blank to define a label panel connected to the bottom of the front panel along a longitudinal perforated line; and g. means to reverse fold the closure panel and label panel over the front panel to position the label panel between the closure panel and the front panel.

4. Apparatus for forming an expansible envelope into a substantially flat condition from a precut one-piece blank of sheet material comprising:

a. means to score the blank to define i. rear, bottom and front panels interconnected along generally parallel longitudinal hinge score lines;

ii. gusset flaps connected to the sides of the front and rear panels along transverse hinge score lines;

iii. bottom gusset panels connected to the ends of the bottom panel along transverse hinge score lines and the ends of the gusset flaps adjacent the bottom panel along longitudinal hinge score lines;

iv. a median longitudinal hinge score line running through the bottom panel and the bottom gusset panels;

v. adhesive flaps connected to a gusset flap on each side of the blank along transverse hinge score lines, said adhesive flaps each having an extension at one end running to the said median longitudinal hinge line and being connected along a hinge score line to its adjacent bottom gusset panel;

vi. a closure panel connected to the top of the rear panel along a longitudinal hinge score line; and the means to score the blank comprising cooperating scoring rolls with one of said rolls having a scoring pattern to impress the hinge score lines on one side of the blank;

b. means to fold inwardly the gusset flaps, the adhesive flaps and their extensions and the bottom gusset panels;

c. means to fold outwardly the adhesive flaps and their extensions over the adjacent gusset flaps;

d. means for applying adhesive along the top surfaces of only the adhesive flaps with the bottom panels being free of adhesive;

e. means to fold the blank along the median longitudinal hinge score line to superimpose the front and rear panels, the adhesive flaps and the gusset flaps, and the adjacent portions of the bottom gusset panels, the means to fold the blank along the median longitudinal hinge score line comprising means for turning the leading edge of the blank upward, rotatable tuckers to press against the gusset flaps adjacent the said median score line while advancing the blank, and pressing means to direct the front panel backward to superimpose the front panel over the rear panel; and f. means to reverse fold the closure panel over the front panel.

* * * * *